US008814707B2

(12) United States Patent
Slattery

(10) Patent No.: US 8,814,707 B2
(45) Date of Patent: Aug. 26, 2014

(54) INTERFACE FOR A PERIPHERAL DEVICE AND A LIGHT TOWER FOR A GAMING MACHINE

(75) Inventor: Brett Lawrence Slattery, Lane Cove (AU)

(73) Assignee: Aristocrat Technologies Australia Pty Limited (AU)

( * ) Notice: Subject to any disclaimer, the term of this patent is extended or adjusted under 35 U.S.C. 154(b) by 1736 days.

(21) Appl. No.: 11/780,818

(22) Filed: Jul. 20, 2007

(65) Prior Publication Data

US 2008/0020838 A1 Jan. 24, 2008

(30) Foreign Application Priority Data

Jul. 20, 2006 (AU) ..... 2006903927

(51) Int. Cl.
*A63F 9/24* (2006.01)

(52) U.S. Cl.
USPC ..... 463/47; 463/20

(58) Field of Classification Search
USPC ..... 463/16, 20, 47
See application file for complete search history.

(56) References Cited

U.S. PATENT DOCUMENTS

| | | | | |
|---|---|---|---|---|
| 7,014,563 | B2 * | 3/2006 | Stephan et al. | 463/47 |
| 7,390,257 | B2 * | 6/2008 | Paulsen et al. | 463/16 |
| 7,442,125 | B2 * | 10/2008 | Paulsen et al. | 463/30 |
| 7,641,554 | B2 * | 1/2010 | Paulsen et al. | 463/42 |
| 2005/0153780 | A1 * | 7/2005 | Gauselmann | 463/47 |
| 2005/0261057 | A1 * | 11/2005 | Bleich et al. | 463/30 |
| 2006/0046824 | A1 * | 3/2006 | Silva et al. | 463/16 |

FOREIGN PATENT DOCUMENTS

| | | | |
|---|---|---|---|
| WO | WO 03/077013 | * | 9/2003 |
| WO | WO 2006122738 A1 | * | 11/2006 |

* cited by examiner

*Primary Examiner* — Jay Trent Liddle
(74) *Attorney, Agent, or Firm* — McAndrews, Held & Malloy, Ltd.

(57) ABSTRACT

An interface for a peripheral device. The interface may be for a light tower (15) of a gaming machine (100). The interface has a first input (L1) to receive first control signals and a first output (L2) connected or connectable to components of the peripheral device, for example stage drivers (50, 51) for LEDs (71). The interface includes an adapter (41) having a second input to receive second control signals and a controller (61) connected to the second input (60) and a second output. The controller (61) is operable to convert second control signals received at the second input (60) into control signals and output the converted signals onto the second output.

17 Claims, 5 Drawing Sheets

INTERFACE FOR A PERIPHERAL DEVICE AND A LIGHT TOWER FOR A GAMING MACHINE

RELATED APPLICATIONS

This application claims priority to an Australian patent application filed on Jul. 20, 2006, as serial number AU2006903927, entitled "An Interface for a Peripheral Device and a Light Tower for a Gaming Machine." The foregoing application is herein incorporated by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates generally to an interface for a peripheral device of a computational controller. One embodiment of the invention relates to electronically configurable lighting devices that are provided as a peripheral device to a computational controller. Another embodiment of the invention relates particularly to programmable and/or configurable light towers for gaming machines and to methods of fitting light towers to gaming machines. Certain embodiments of the present invention also relate to a gaming machine fitted with such a light tower.

Light towers, otherwise known as candles, are often provided on gaming machines as a visual status indicator of their gaming machine. The light towers include one or more stages, typically up to four stages of different colours, which can be lit independently of each other.

Each status of the gaming machine that needs to be distinctly identified is ideally indicated by the light tower by a lighting arrangement unique to the status. For example, the lighting arrangement that indicates that a player of the gaming machine has requested a service call may be the lighting of a particular stage. Where there are more statuses than stages, then a stage may be turned on and off at different intervals to enable the one stage to indicate a plurality of distinct statuses.

Different existing gaming machines may communicate control signals to their light tower using different methods. For example, in some machines the control signals are serial commands received from the backplane and a serial peripheral interface (SPI) of the gaming machine, which are communicated to the mechanical meters of the gaming machine and converted into a parallel 4 bit lamp driver interface before being communicated to the light tower. The 4 bit lamp driver interface then directly drives the lamps in the light tower. In other machines, the 4 bit lamp driver interface may be directly connected to the backplane or a motherboard of the gaming machine. In still further alternative machines the control signal may be serial commands from the backplane or motherboard of the machine through the SPI, in which case the light tower receives the serial commands and drives lights the stages in response.

When provided, the SPI, in addition to providing control signals to the light tower, typically also provides an interface to other peripherals of the gaming machine.

Different gaming venues may require a different lighting arrangement for the same status. One way to achieve this in the past has been to provide coloured plastic inserts on the light tower to achieve the required lighting arrangement. This method has been traditionally used for light towers with incandescent bulbs for the stages. However, the method is inefficient as it requires a person to physically change the plastic inserts. There is a need for an alternative method of configuring a light tower, which preferably reduces the labour required in changing a lighting arrangement and which also preferably minimises the cost of production of the light tower and gaming machine with a light tower fitted.

BRIEF SUMMARY OF THE INVENTION

According to a first aspect of the invention, there is provided a light tower for a gaming machine, the light tower including a first input and one or more stages operable to be controllably lit in any one of a plurality of colours by one or more stage drivers communicably connected or connectable to the first input and operable in response to first control signals communicated to the first input in a first protocol, the light tower further including an adapter having a second input, a controller and a signal output, wherein the light tower is further operable to receive second control signals communicated to the second input in a second protocol different from the first protocol and in response thereto use the signal output to control the one or more stage drivers to controllably light the one or more stages.

In one embodiment, the signal output is communicably connected or connectable to the one or more stage drivers over one or more communication lines and the light tower uses the signal output to controllably light the one or more stages by providing on the signal output control signals in the first protocol.

In one embodiment, the light tower is operable to selectively communicably connect either the signal output or the first input to the one or more stage drivers.

In one embodiment, the adapter is removable from the light tower and wherein when the adapter is removed, the stage driver for each stage is communicably connected to the first input and wherein when the adapter is not removed, the stage driver for each stage is disconnected from the first input.

In another embodiment, the adapter is integral with the light tower. In this embodiment, the controller of the adapter may be implemented as an integrated circuit device that includes first and second sets of input pins that form at least a part of the first and second inputs respectively. The integrated circuit device may also include the one or more stage drivers.

In one embodiment, the light tower includes a plurality of stage drivers, each operable to controllably light one or more stages. In this embodiment, each stage driver may operate to controllably light a stage in response to receipt of control signals in said first protocol.

In one embodiment, the adapter is configurable into a plurality of configurations, allowing the controller of the adapter to cause a different lighting arrangement of said stages when the same control signal is received at the second input when in different configurations.

In one embodiment, the adapter is configured by configuration commands received at the first input of the light tower.

In either or both of the embodiments described in the preceding two paragraphs, the adapter may include programmable hardware forming a part of, or readable by the controller, to determine what signals to output on the signal output in response to the receipt of said second control signals at the second input, and the configuration commands cause the programmable hardware to be reprogrammed.

In one embodiment, the one or more stage drivers are communicably connected to the first input.

According to a second aspect of the invention, there is provided a light tower for a gaming machine, the light tower including a first input for connection to a game controller of a gaming machine and one or more stages operable to be controllably lit in any one of a plurality of colours by one or more stage drivers communicably connected or connectable to the first input and operable in response to first control signals communicated to the first input in a first protocol, the light tower further including an adapter having a second input, a controller and a signal output, wherein the light tower is further operable to receive second control signals communicated to the second input in a second protocol different from the first protocol and in response thereto convert the second control signals into the first protocol according to conversion rules implemented by the controller, wherein the controller is configurable to thereby allow modification of the conversion rules.

In one embodiment, the controller is configurable by configuration commands received at the first input.

In one embodiment, the controller is either a microprocessor or a programmable logic device.

In one embodiment, the adapter is removable from the light tower, wherein when the adapter is removed, the stage driver for each is communicably connected to the first input and wherein when the adapter is not removed, the stage driver for each stage is disconnected from the first input.

In an alternative embodiment, the adapter is integral with the light tower, the controller is part of an integrated circuit device having separate input pins for first and second inputs and optionally also including the stage drivers.

According to a third aspect of the present invention, there is provided a light tower for a gaming machine, the light tower having one or more stages able to be controllably lit by one or more stage drivers in any one of a plurality of colours in response to control signals received at an input communicably connected to the one or more stage drivers, and a means to connect an intelligent device to the light tower, said means operable to disconnect the first input from the stage drivers and instead connect the first input to an output line connectable to an input to the intelligent device and communicably connect an alternative input to the one or more stage drivers, the alternative input connectable to an output of the intelligent device.

In one embodiment, the means to connect an intelligent device to the light tower is further operable to receive a return signal from the one or more stage drivers and selectively direct the return signal to a first output or a second output, wherein the second output is connectable to the intelligent device.

According to a fourth aspect of the invention, there is provided a gaming machine having a display and a user interface communicably connected to a game controller, the game controller operable to control the gaming machine to provide a game, the gaming machine further including a light tower in communication with the game controller through both a serial communication link and a parallel lamp driver interface, wherein the game controller causes lighting of the light tower in a particular lighting arrangement by placing control signals onto the parallel lamp driver interface and causes reconfiguration of the light tower by placing reconfiguration commands on the serial communication link, the reconfiguration commands modifying the particular lighting arrangement associated with at least one signal on the parallel lamp driver interface.

In one embodiment, the parallel lamp driver interface is a 4 bit lamp driver interface.

In one embodiment, the game controller and the light tower are further adapted to allow the game controller to cause lighting of the light tower by placing serial control signals onto the serial communication link. In this embodiment, the light tower may be adapted to give priority to the serial control signals over control signals received on the parallel lamp driver interface.

In one embodiment, the reconfiguration commands are placed on the serial communication link by the game controller as a result of reconfiguration action by an operator of the gaming machine using the user interface.

In one embodiment, the gaming machine further includes an interface to an external communication channel and the reconfiguration commands are communicated along the serial communication link in response to particular information received by the interface from the external communication channel.

According to a fifth aspect of the invention, there is provided an interface for a peripheral device, the interface having a first input to receive first control signals communicated to the first input in a first protocol and a first output in communication with the first input, wherein the first output is connected or connectable to one or more active components of a peripheral device, the interface further comprising an adapter having a second input to receive second control signals communicated to the second input in a second protocol different from the first protocol, a second output connected or connectable to the same components of the peripheral device as the first output and a controller connected to the second input and the second output and operable to convert second control signals received at the second input into control signals in the first protocol and output the converted signals onto the second output.

According to a sixth aspect of the invention, there is provided an interface for a peripheral device, the interface having a first input for receiving first control signals from a computational controller in a first protocol and a first output in communication with the first input, wherein the first output is connected or connectable to one or more controllable active components of a peripheral device, the interface further comprising an adapter having a second input to receive second control signals communicated to the second input in a second protocol different from the first protocol, a second output connected or connectable to the same components of the peripheral device as the first output and a configurable controller connected to the second input and the second output, the configurable controller being configurable in response to configuration commands received at the first input and operable to place control signals for a peripheral device on the second output in response to receipt of second control signals at the second input.

In one embodiment of either the fifth or sixth aspects of the invention, the adapter is removably connected to the interface, and wherein when the connector is connected to the interface, the controller of the adapter is further in communication with the first input and is configurable by configuration commands received at the first input. In this embodiment, when the adapter is connected to the interface, the first input is disconnected from the first output and re-routed to the controller of the adapter.

In one embodiment, the adapter is able to be enabled and disabled, wherein when the adapter is enabled the controller of the adapter is further in communication with the first input and is configurable by configuration commands received at the first input. In this embodiment, when the adapter is enabled the first input may be disconnected from the first output and re-routed to the controller of the adapter.

In one embodiment, the adapter is removable from the interface, wherein when the adapter is removed, the one or more active components are communicably connected to the first input and wherein when the adapter is not removed, the one or more active components are disconnected from the first input.

In one embodiment, the adapter is integral with the interface. In this embodiment, the controller may be part of an integrated circuit device having input pins for the first and second inputs.

In one embodiment, the interface is operable to selectively connect one of the first output and the second output to the one or more active components of a peripheral device by operating one or more switches. In this embodiment, the state of the switches may be determined by the adapter.

In one embodiment, the interface forwards the first control signals from the first input to the first output without converting the signals into a different protocol.

In a particular implementation of the fifth and sixth aspects, the computational controller is a game controller for a gaming machine and the peripheral device is a light tower for the gaming machine.

Further aspects of the present invention and further embodiments of the aspects described in the preceding paragraphs will become apparent from the following description, given by way of example and with reference to the accompanying drawings.

Figure 1:
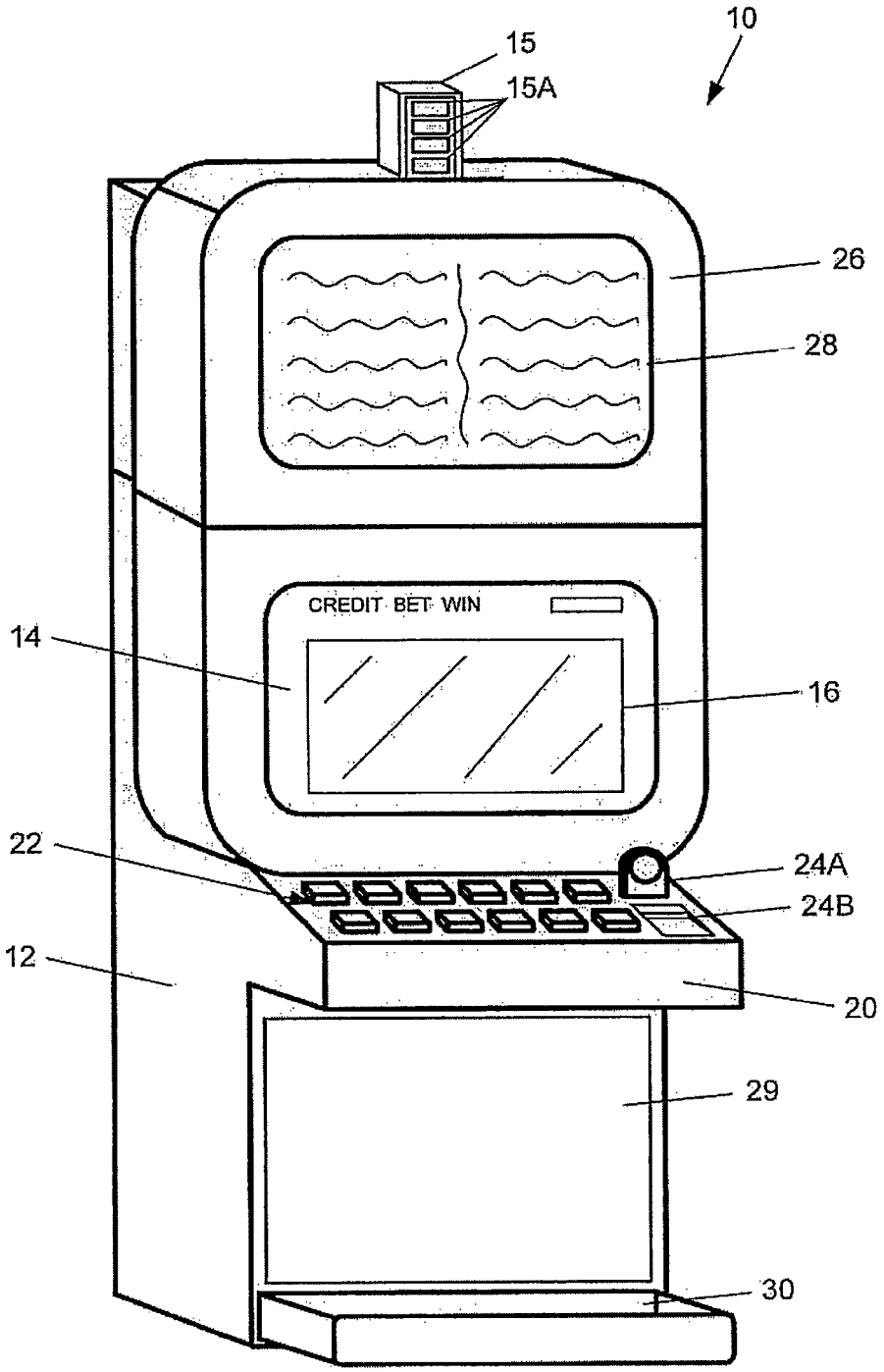
FIG. 1 shows diagrammatically, a view of a gaming machine with a light tower according to an embodiment.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

The present invention relates generally to a peripheral interface for a peripheral device of a computational controller. Certain embodiments of invention may have particular application to a peripheral interface of a light tower of a gaming machine and the following description is given by way of example to this application. However, certain embodiments of the present invention may also have useful application to other peripheral devices and controllers.

In FIG. 1 of the accompanying drawings, one example of a gaming machine suitable for use with an interface and a light tower according to an embodiment of the present invention is generally referenced by arrow 10.

The gaming machine 10 includes a console 12 having a display 14 on which is displayed representations of a game 16, that can be played by a player. A mid-trim 20 of the console 12 houses a bank of buttons 22 for enabling a player to play the game 16. The mid-trim 20 also houses a credit input mechanism 24 including a coin input chute 24A and a bill collector 24B. A top box 26 may carry artwork 28, including for example, pay tables and details of bonus awards and other information or images relating to the game. Further artwork and/or information may be provided on the front panel 29 of the console 12. A coin tray 30 is mounted beneath the console 12 for cash payouts from the gaming machine 10.

The display 14 shown in FIG. 1 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or a different type of display.

A light tower 15 is located on the top box 26 and has four stages 15A, which are lit to indicate the status of the gaming machine 10. Depending on the particular gaming machine 10, and the jurisdiction where the gaming machine 10 is to be played, the light tower 15 may have between two and four stages 15A.

Figure 2:
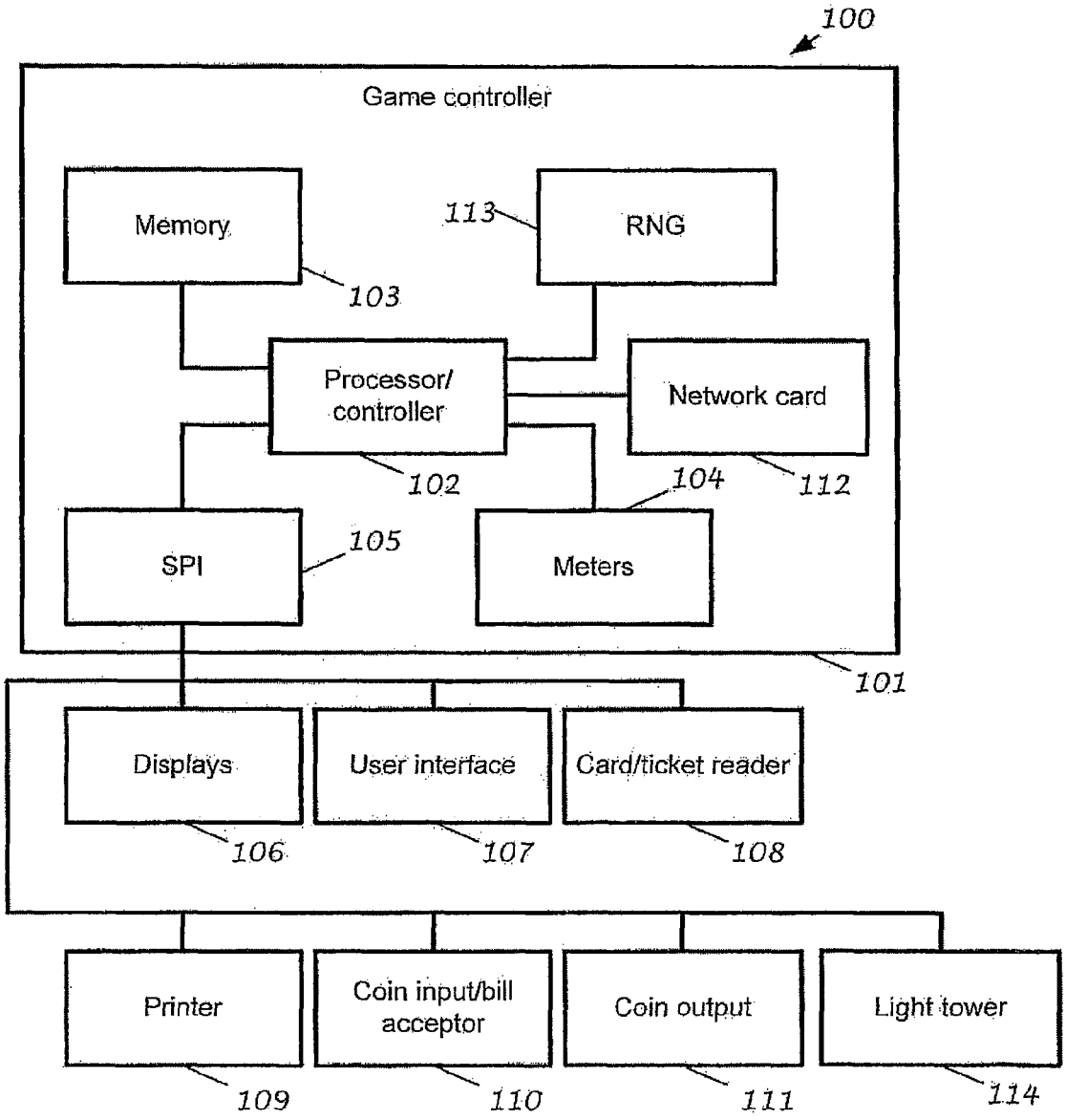
FIG. 2 shows a block diagram of gaming apparatus suitable for communicating and controlling a light tower according to an embodiment of the present invention.

FIG. 2 shows a block diagram of a gaming machine, generally referenced by arrow 100, suitable for use with the light tower according to an embodiment of the present invention. The gaming machine 100 may, for example, operate as a standalone gaming machine of the type shown in FIG. 1. However, the gaming machine 100 may alternatively operate as a networked gaming machine, communicating with other network devices, such as one or more servers or other gaming machines. The gaming machine 100 may also have distributed hardware and software components that communicate with each other directly or through a network. Accordingly, different reference numerals have been used in FIG. 2 from FIG. 1 for components that may be equivalent.

The gaming machine 100 includes a game controller 101, which in the illustrated example includes a microprocessor, microcontroller, programmable logic device or other computational device 102. Instructions and data to control operation of the computational device 102 are stored in a memory 103, which is in data communication with the computational device 102, or which forms a part of the computational device 102. Typically, the gaming machine 100 will include both volatile and non-volatile memory and more than one of each type of memory, with such memories being collectively represented by the memory 103.

The gaming apparatus may include hardware meters 104 for the purposes of regulatory compliance and also include an input/output (I/O) interface for communicating with the peripheral devices of the gaming machine 100. The input/output interface and/or the peripheral devices may be intelligent devices with their own memory for instructions and data. In an embodiment as presently contemplated the input/output interface may be a serial peripheral interface (SPI) 105 of the type described in Australian patent number 690799, which is incorporated herein by reference in its entirety. The serial connection may be USB or another communication protocol.

In the example shown in FIG. 2, the peripheral devices that communicate with the controller are one or more displays 106, user interfaces 107 (which include the display or displays 106), a card and/or ticket reader 108, a printer 109, a bill acceptor and/or coin input mechanism 110, a coin output mechanism 111 and a light tower 114, which may be the same as the light tower 15 shown in FIG. 1. Additional devices may be included as part of the gaming machine 100, or devices omitted as required for the specific implementation.

The SPI 105 controls the lighting of the light tower 114. However, alternatively and as described previously herein, the light tower 114 may be lit by a 4 bit lamp driver interface (not shown in FIG. 2) that may communicated to the light tower 114 via the meters 104 or directly from the backplane of the gaming machine 100. These alternative configurations are typical of legacy gaming machines, with many modern gaming machines instead using a serial communication interface to control a light tower.

In addition, the gaming machine 100 may include a communications interface, for example a network card 112 or a machine communications interface that may also include the SPI 105. The network card 112 may for example, send status information, accounting information or other information to a central controller, server or database and receive data or commands from the central controller, server or database. As explained in more detail in relation to FIG. 4, the computational device 102 may include two or more controllers or processors, which may be local or remote from each other and the display(s) 106.

Figure 3:
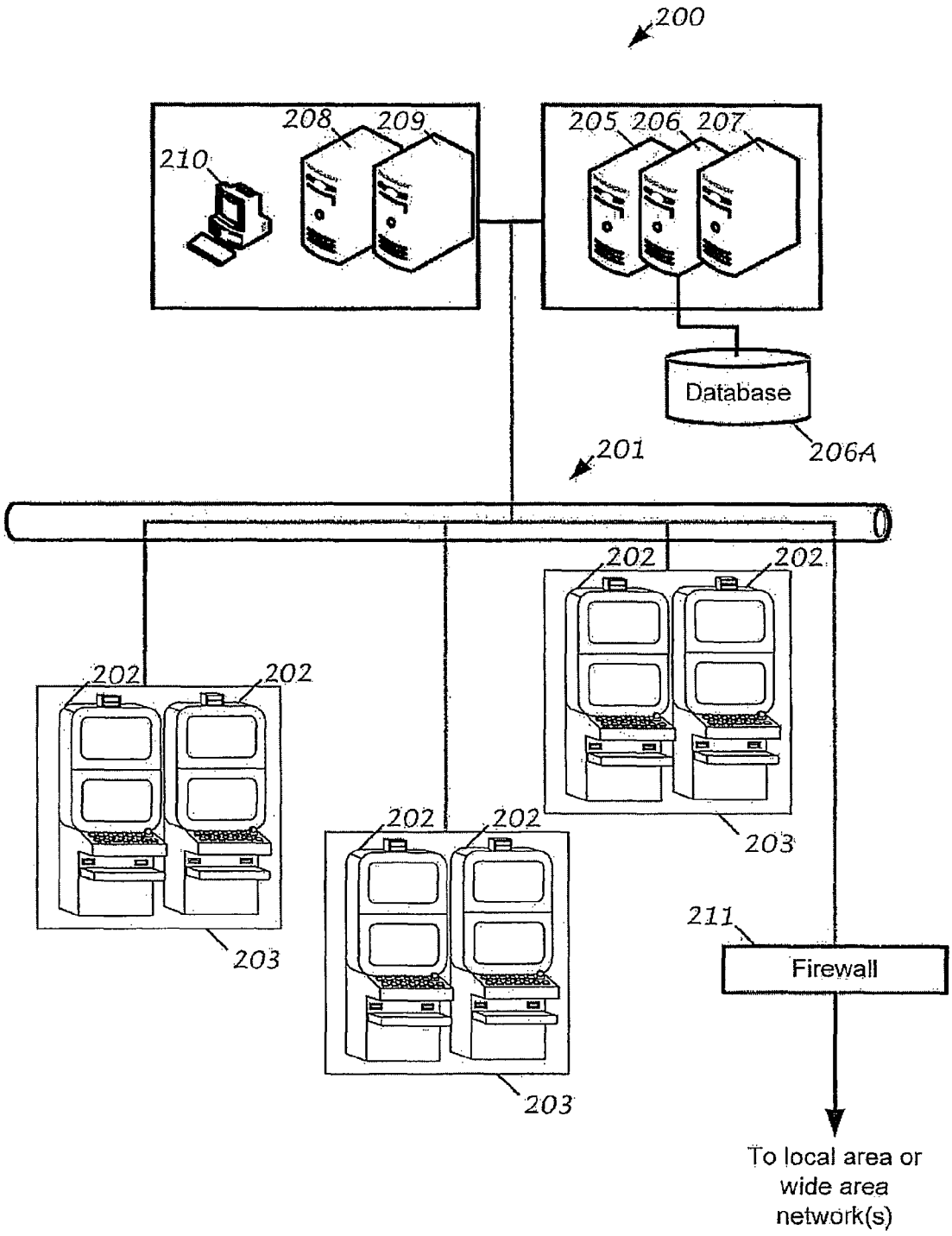
FIG. 3 shows diagrammatically, a network gaming system suitable for communicating with and configuring a light tower according to an embodiment of the present invention.
Figure 4:
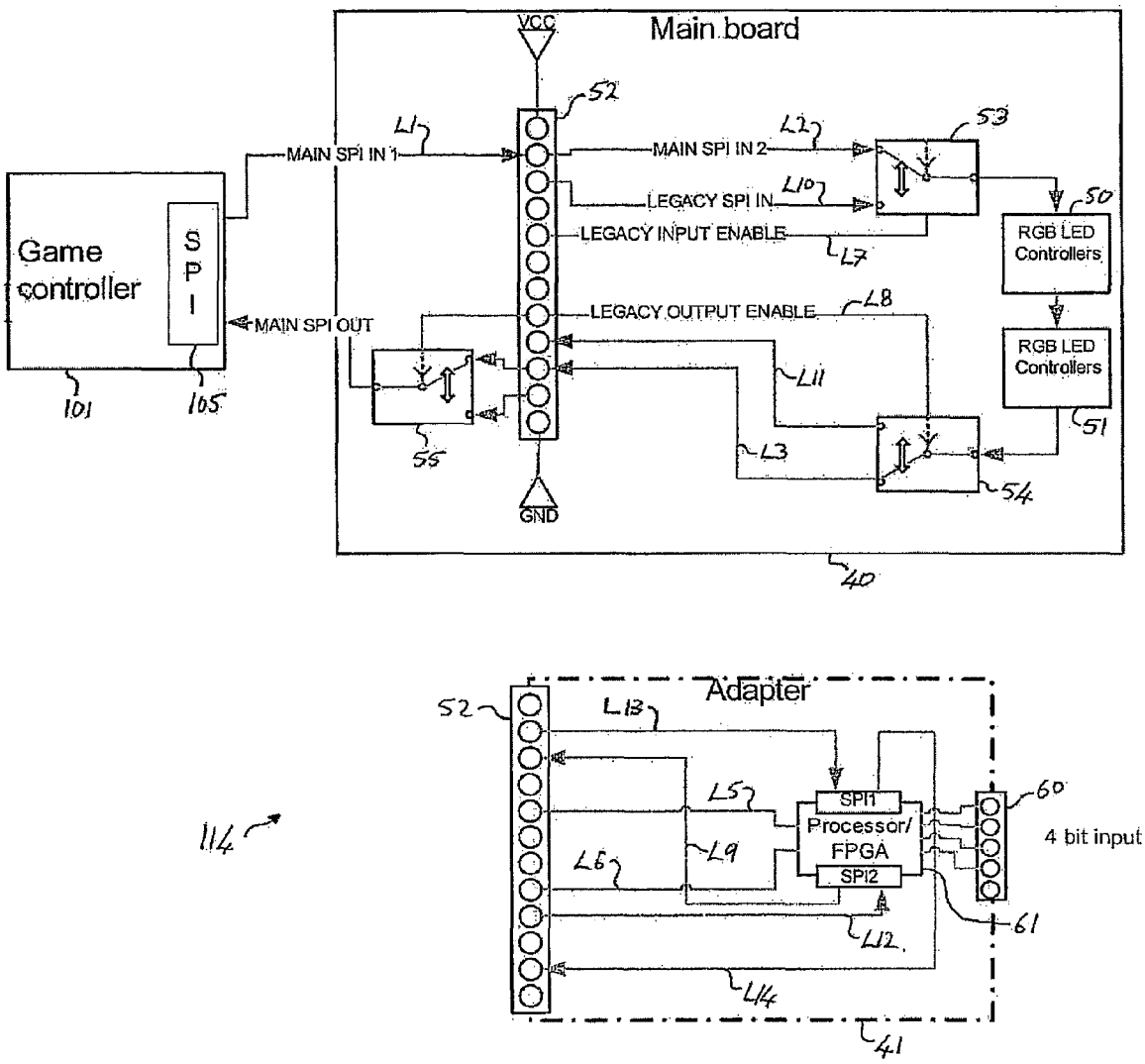
FIG. 4 shows diagrammatically, a circuit layout of a light tower according to an embodiment of the present invention, in communication with a game controller.

FIG. 3 shows a gaming network 200 according to an embodiment of the present invention. The gaming network 200 includes a communications network 201, which for example may be an Ethernet. Gaming devices 202, shown arranged in three banks 203 of two gaming devices 202 in FIG. 4, are connected to the network 201. The gaming devices 202 may be gaming machines 10, as shown in FIG. 1 or form part or all of another gaming machine 100. Single gaming devices 202 and banks 203 containing three or more gaming devices 202 may also be connected to the network 201.

Servers may also be connected to the network 201. For example, a game server 205 may generate game outcomes for games played on the gaming devices 202, a database management server 206 may manage the storage of game programs and associated data for downloading or access by the gaming devices 202 in a database 206A, and a jackpot server 207 may control one or more jackpots associated with the gaming devices 202.

Further servers may be provided to assist in the administration of the gaming system 200, including for example a gaming floor management server 208, and a licensing server 209 to monitor the use of licenses to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet through a firewall 211.

FIG. 4 shows diagrammatically a circuit diagram of a light tower 114 according to an embodiment of the present invention in communication with a game controller 101 through the SPI 105. The light tower 114 may be located on the gaming devices 202, on the gaming machine 10 or on other gaming machines. The light tower 114 has two main components, a main board 40 and an adapter 41. The adapter 41 is removably connectable to the main board 40.

Figure 5:
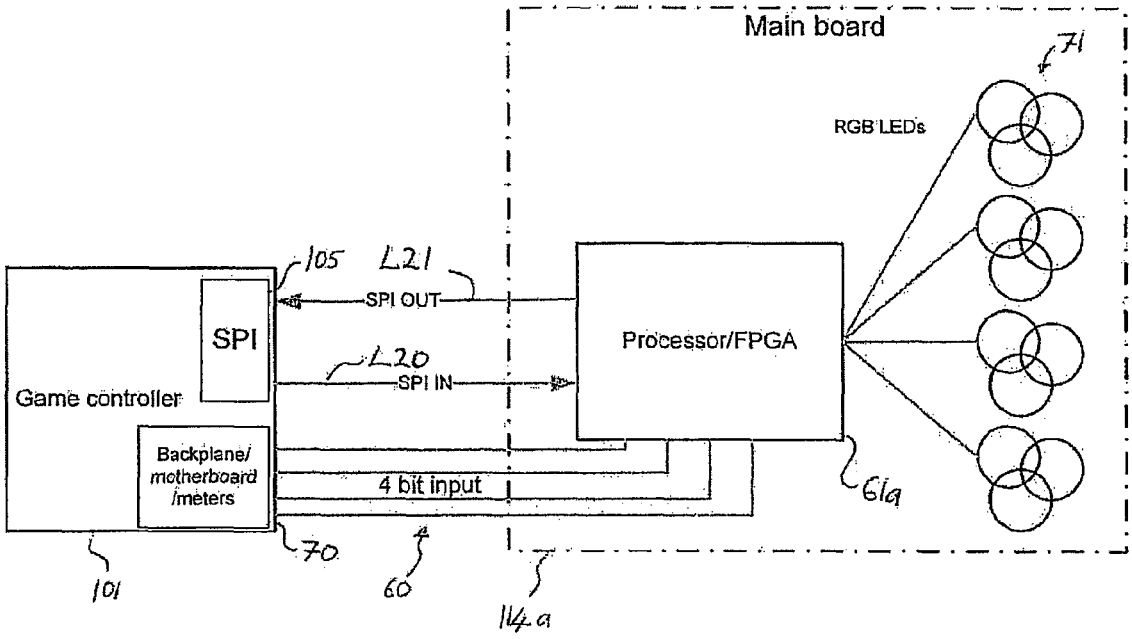
FIG. 5 shows diagrammatically, a circuit layout of a light tower according to an alternative embodiment of the present invention in communication with a game controller.

The light tower 114 has two stages, with each stage having red, green and blue light emitting diodes (not shown in FIG. 4) and a stage driver 50, 51. The stage drivers 50, 51 are typically integrated circuit devices and may be implemented in a single device, or implemented as separate devices. As shown in FIG. 5, the stage drivers may be daisy chained and the following description assumes a daisy chain configuration, although this is not essential. The stage drivers 50, 51 can cause each stage to be lit in a plurality of different colours by driving different combinations of diodes in each stage and/or by controlling the current through each of the diodes.

When game controller 101 that the light tower 114 is connected to, or is to be connected to, operates to control the lighting of the light tower 114 through serial commands from the SPI 105, then the light tower is placed in a first configuration without the adapter 41, or with the adapter 41 disabled. In this configuration, the game controller 101 uses the SPI 105 to send the control signals over the "MAIN SPI IN 1" line L1 shown in FIG. 4. Where the game controller 101 is located proximate the light tower 114 the line L1 may be a direct line. Where the game controller 101 is located remote from the light tower 114, the line L1 may include a network, particularly if the game controller 101 controls a plurality of gaming devices 202. The line L1 connects to a terminal 52, which connects the line L1 to a second line L2, named "MAIN SPI IN 2" in FIG. 4. The line L2 connects to a switch 53, which may be a mechanical switch, hardware implementing a logic function, a relay, jumpers or other switching device. From the switch 53 the serial commands are communicated to the stage drivers 50, 51. Return signals from the stage drivers 50, 51 are communicated through the switch 54 along line L3 to the terminal 52 and through the switch 55 to the game controller 101 along line L4, named "MAIN SPI OUT" in FIG. 4.

Although the light tower 114 forwards the signals received on the line L1 to the line L2 and on to the stage drivers 50, 51 without conversion or modification, in some alternative embodiments, depending on the particular peripheral device and particular controller and the way they communicate with each other, protocol conversion and/or modification (eg filtering, amplification etc) may be required. For example, if the computational controller was remote from the peripheral device and communicated with the peripheral device through a network, then the payload of the packets received from the network may need to be extracted and sequenced before being passed on to the peripheral device. Typically this would be performed by a local controller for all the peripheral devices at that local controller. This local controller could be included on a peripheral interface of certain embodiments of the present invention and used for providing signals to one or more peripheral interfaces.

When the game controller 101 that the light tower 114 is connected to, or is to be connected to, operates to control the lighting of the light tower 114 through a 4 bit interface, then the light tower is placed in a second configuration that includes the adapter 41. When the light tower 114 is configured with the adapter 41 and the adapter 41 is enabled if it is able to be disabled when connected to the main board 40, then it receives power from the power supply VCC at the terminal 52 and causes lines L5 and L6 and consequently lines L7 and L8, named "Legacy Input Enable" and "Legacy Output Enable" respectively in FIG. 4, to go "high". This causes the switches 53, 54 and 55 to switch from the state shown in FIG. 4 to their alternate state. The result is that line S2 is disconnected from the stage drivers 50, 51 by the switch 53, disconnecting the game controller 101 from the stage drivers 50, 51 and similarly line L4 is disconnected from the stage drivers 50, 51 by switches 54 and 55. If the switches 53, 54 are jumpers, then lines L7 and L8 may be omitted and the switching performed manually.

The adapter 41 connects to the 4 bit interface at the 4 bit input 60 and the signals received at the 4 bit input 60 are communicated to an adapter controller 61, which may be a processor with associated memory, or field programmable gate array (FPGA) or other suitable configurable controller. The adapter controller 61 converts the lighting signals received at the 4 bit input 60 into serial commands executable by the stage drivers 50, 51 according to predetermined conversion rules and outputs the serial commands onto line L9. The rules could be implemented as a look-up table if the adapter controller 61 is a processor or by firmware reprogramming if the adapter controller 61 is a FPGA. Although the conversion rules may be fixed, in an embodiment they are configurable, to enable the same lighting signal at the 4 bit input 60 to result in a different action by the stage drivers 50, 51, depending on the conversion rules. This configurability of the conversion rules may allow the light tower 114 to be used in a range of jurisdictions. In embodiments where the conversion rules are fixed, then the adapter controller may not be configurable, for example implemented as a dedicated integrated circuit.

The serial commands are received by the terminal 52 from line L9, then communicated along line L10 of the main board 40 to the stage drivers 50, 51 via the switch 53. The return signal is communicated along lines L11 and L12 back to the adapter controller 61.

The adapter controller 61 may be configured and/or programmed by the game controller 101 by generating configuration or programming commands onto the line L1. The commands may be generated by the computational device 102, or alternatively received by the game controller 101 through the network card 112 and passed on to the adapter controller 61 via the SPI 105. The passage of the commands may be via the computational controller 102, or where the network card 112 is part of a machine communications interface with the SPI 105 or is otherwise connected t the SPI 105, the computational controller 102 may be bypassed.

The configuration or programming commands are transferred onto line L13 of the adapter 41 by the terminal 52 and received by a serial peripheral interface SP11 of the adapter controller 61. Reconfiguration commands result in the adapter controller 61 using different conversion rules to convert the lighting signals received at the 4 bit input 60 into serial commands. Programming commands cause the adapter controller 61 to operate according to new instructions. The adapter controller 61 may communicate signals to the game controller 101, for example to confirm reconfiguration or programming, by generating signals on line L14, which are transferred to line L4 via the terminal 52 and the switch 55.

If when the adapter 41 is connected to the main board 40 and enabled to receive control signals from the 4 bit input 60 to control the stage drivers 50, 51, control signals are received on the line L1, the adapter 41 may give priority to one of the signals. In certain embodiments, the adapter controller 61 gives priority to the signals on line L1, which it receives on line L13, by identifying them as control signals (a bit or group of bits in a packet may identify whether it is a control signal, configuration command or programming command) and then outputting the control signal onto L9 to be received by the stage drivers 50, 51 via line L10 and switch 53. While control signals are being received on line L1, the adapter controller 61 will not act on signals received at the 4 bit input and may continue not to act on such signals until a predetermined event occurs, such as a time period elapsing or administrator intervention.

FIG. 5 shows a light tower 114*a* according to an embodiment of the present invention, which is connected to a game controller 101. The light tower 114*a* has a controller 61*a*, which may be a processor, an FPGA or another programmable logic device. The controller 61*a* receives a serial input on line L20 and has a serial output on line L21, which connect to the SPI 105 of the game controller 101. The controller 61*a* also receives signals from a 4 bit input 60, sourced from a backplane, motherboard or meters 70 associated with or forming part of the game controller 101.

In one embodiment, the controller 61*a* may be an integrated circuit device that incorporates functional equivalents to the adapter controller 61, switches 53-55 and stage drivers 50, 51 of the light tower 114. Internal connections replace the lines L1-L14. Alternatively, the stage drivers 50, 51 may be kept separate of the controller 61*a*. Therefore, the controller 61*a* is able to light the LEDs 71 dependent on signals received from the SPI 105 of the game controller 101 and dependent on signals received at the 4 bit input 61A. This allows the light tower 114 to be used with game controllers 101 that use their SPI 105 to control a light tower and with game controllers 101 that output a 4 bit signal to control a light tower. Like the controller 61 of the light tower 114, the controller 61*a* may give priority to control signals received on line L20 over those received on the 4 bit input and may also be configured or programmed by configuration/programming commands received on line L20.

The game controller 101 may allow an operator to configure the light tower 114 by entering a set up screen on the gaming machine 100 to which the light tower 114 is connected. In this case, the memory 103 readable by or part of the game controller 101 may contain instructions to display on a display 106 a configuration screen and allow the operator to select parameters that govern the conversion rules of the adapter controller 61. The game controller 101 would then send configuration (or reconfiguration) commands onto line L1 in response to any change in the set up by the operator.

Alternatively, or in addition, the game controller 101 may receive configuration commands from the network 201 and forward these to the adapter controller 61. This would allow an operator to use the administrator terminal 210 to configure or reconfigure one or more light towers 114 from a central location. The administrator terminal 210 may instruct the floor manager server 208 or other server to send the configuration commands. Also, reconfiguration may be performed through a local or wide area network, for example through signals sent to the network 201 through the firewall 211 (see FIG. 3).

Programming or reprogramming of the adapter controller 61 may be achieved using the same methods. Configuration and programming of the light tower 114*a* may be achieved using similar methods.

Although in the foregoing description of certain embodiments of the invention, the adapter controller 61 converts the lighting signals received at the 4 bit input 60 to serial commands of the same protocol as those received from the game controller 101 to control the stage drivers 50, 51, in alternative embodiments the conversion may be to a different protocol. However, this would likely increase the cost of the light tower 114, as it then would have to be able to drive the light emitting diodes in response to two different signals.

Where in the foregoing description reference has been made to integers having known equivalents, then those equivalents are hereby incorporated herein as if individually set forth.

Those skilled in the relevant arts will appreciate that modifications and additions to the embodiments of the present invention may be made without departing from the scope of the present invention as defined in the appended claims.

It will be understood that the invention disclosed and defined in this specification extends to all alternative combinations of two or more of the individual features mentioned or evident from the text or drawings. All of these different combinations constitute various alternative aspects of the invention.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A light tower for a gaming machine, the light tower comprising:

a first input;

one or more stage drivers configured to receive first lighting control signals communicated from a game controller to the first input, wherein the first lighting control signals from the first input are in a first control signal protocol, wherein the one or more stage drivers provide one or more driver output signals in response to the first lighting control signals;

one or more stages configured to be lit in one or more of a plurality of colors in response to the one or more driver output signals; and an adapter having a second input, an adapter controller, and a control signal output, wherein the adapter is configured to receive second lighting control signals communicated from the game controller to the second input in a second control signal protocol that is different from the first control signal protocol, wherein the adapter controller is responsive to the control signals provided at the second input in the second control signal protocol to generate, based on a predefined set of conversion rules, lighting control signals in the first control signal protocol for provision at the control signal output to the one or more stage drivers for use in generating the one or more driver output signals to the one or more stages, wherein the adapter controller is configured to:

receive a reconfiguration command from the game controller; and process the reconfiguration commands to create a new set of conversion rules.

2. The light tower of claim 1, wherein the light tower is configured to selectively provide control signals from either the first input or the adapter to the one or more stage drivers.

3. The light tower of claim 1, wherein the adapter is removable from the light tower, wherein the stage driver for each stage is to configured to automatically provide the first lighting control signals from the first input to the one or more stage drivers when the adapter is removed from the light tower, and wherein the stage driver for each stage is automatically connected to receive first lighting control signals from the adapter when the adapter is connected to the light tower.

4. The light tower of claim 1, wherein the adapter is integral with the light tower.

5. The light tower of claim 4, wherein the adapter controller comprises an integrated circuit device that includes at least one set of input pins that form at least a part of the second input.

6. The light tower of claim 5, wherein the integrated circuit device further comprises the one or more stage drivers.

7. The light tower of claim 1, wherein the one or more stage drivers comprises a plurality of stage drivers, each configured to controllably light the one or more stages.

8. The light tower of claim 1, wherein the adapter controller is configured to cause a different lighting arrangement of the one or more stages when a same lighting control signal is received at different times at the second input.

9. The light tower of claim 1, wherein the reconfiguration command is received at the first input of the light tower.

10. The light tower of claim 1, wherein the one or more stage drivers are communicably connected to the first input.

11. A light tower for a gaming machine, the light tower comprising:

a first input configured for connection to a game controller of the gaming machine;

one or more stage drivers configured to receive first lighting control signals provided from the game controller to the first input, wherein the first lighting control signals are in a first control signal protocol, and wherein the one or more stage drivers provide one or more driver output signals in response to the first lighting control signals;

one or more stages configured to be lit in any one of a plurality of colors in response to the one or more driver output signals; and an adapter having a second input, an adapter controller and a signal output, wherein the adapter is configured to receive second lighting control signals communicated from the game controller to the second input in a second control signal protocol different from the first control signal protocol and in response thereto convert the second lighting control signals into the first control signal protocol according to a predefined set of conversion rules implemented by the adapter controller for provision to the one or more stage drivers, wherein the adapter controller is configured to:

receive a reconfiguration command from the game controller; and process the reconfiguration command to create a new set of conversion rules.

12. The light tower of claim 11, wherein the adapter controller is reconfigured in response to reconfiguration commands received at the first input.

13. The light tower of claim 11, wherein the adapter controller is selected from a group of electronic components comprising a microprocessor or a programmable logic device.

14. The light tower of claim 11, wherein the adapter is removable from the light tower, wherein the one or more stage drivers are configured to receive the lighting control signals provided from the game controller to the first input, and wherein the one or more stage drivers for each stage is configured to receive the lighting control signals from the adapter when the adapter is connected with the light tower.

15. The light tower of claim 11, wherein the adapter is integral with the light tower, and wherein the adapter controller is part of an integrated circuit device having separate input pins for first and second inputs.

16. A light tower for a gaming machine, the light tower comprising:

stage driver means for providing one or more driver output signals in response to lighting control signals received in a first control signal protocol communicated from a game controller;

stage means, responsive to the driver output signals, for lighting stages in one or more of a plurality of colors;

first means for providing lighting control signals in the first control signal protocol;

second means for providing lighting control signals in the first control signal protocol, wherein the second means generates its lighting control signals in the first control signal protocol in response to lighting control signals received in a second control signal protocol communicated from the game controller that is different from the first control signal protocol, wherein the second means converts the lighting control signals received in the second control signal protocol to the first control signal protocol using a predefined set of conversion rules, and wherein the second means is configured to receive a reconfiguration command from a game controller that is remote to the second means and to process the reconfiguration commands to create a new set of conversion rules; and selection means for automatically selecting lighting control signals from either the first means or the second means for input to the stage driver means.

17. The light tower of claim 16, wherein the second means comprises an intelligent device, wherein the selection means is further configured to receive a return signal from the one or more stage drivers and to selectively direct the return signal to a first output or a second output, wherein the second output is configured for connection to the intelligent device.

* * * * *